US007121860B2

(12) United States Patent
Cram et al.

(10) Patent No.: US 7,121,860 B2
(45) Date of Patent: Oct. 17, 2006

(54) PINCH-STYLE SUPPORT CONTACT, METHOD OF ENABLING ELECTRICAL COMMUNICATION WITH AND SUPPORTING AN IC PACKAGE, AND SOCKET INCLUDING SAME

(75) Inventors: Daniel P. Cram, Boise, ID (US); Amos J. Stutzman, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/933,844

(22) Filed: Sep. 2, 2004

(65) Prior Publication Data

US 2006/0046554 A1 Mar. 2, 2006

(51) Int. Cl.
*H01R 11/22* (2006.01)

(52) U.S. Cl. ..... 439/266; 439/264; 439/70

(58) Field of Classification Search ..... 439/330–331, 439/266, 264, 70, 265, 267–268
See application file for complete search history.

(56) References Cited

U.S. PATENT DOCUMENTS

| | | | | | |
|---|---|---|---|---|---|
| 5,059,135 | A | * | 10/1991 | Matsuoka et al. | 439/268 |
| 5,482,471 | A | * | 1/1996 | Mori et al. | 439/263 |
| 5,578,870 | A | | 11/1996 | Farnsworth et al. | 257/727 |
| 5,611,705 | A | | 3/1997 | Pfaff | 439/266 |
| 5,690,281 | A | * | 11/1997 | Ikeya et al. | 439/268 |
| 5,829,988 | A | | 11/1998 | McMillan et al. | 439/70 |
| RE36,217 | E | | 6/1999 | Petersen | 324/755 |
| 6,027,355 | A | | 2/2000 | Ikeya | 439/268 |
| 6,050,836 | A | | 4/2000 | Tohyama | 439/266 |
| 6,126,467 | A | | 10/2000 | Ohashi | 439/268 |
| 6,139,348 | A | | 10/2000 | Fukunaga | 439/266 |
| 6,168,449 | B1 | | 1/2001 | Huang et al. | 439/259 |
| 6,261,114 | B1 | | 7/2001 | Shimada | 439/266 |
| 6,280,219 | B1 | | 8/2001 | Sano et al. | 439/268 |
| 6,287,127 | B1 | | 9/2001 | Himino et al. | 439/70 |
| 6,345,999 | B1 | | 2/2002 | Okuyama et al. | 439/268 |
| 6,350,138 | B1 | | 2/2002 | Atobe et al. | 439/266 |
| 6,371,783 | B1 | | 4/2002 | Ohashi et al. | 439/268 |
| 6,402,528 | B1 | | 6/2002 | Takahashi et al. | 439/70 |
| 6,402,537 | B1 | | 6/2002 | Ikeya | 439/259 |
| 6,428,337 | B1 | * | 8/2002 | Ohshima et al. | 439/266 |
| 6,471,531 | B1 | * | 10/2002 | Kanesashi | 439/268 |
| 6,614,247 | B1 | | 9/2003 | Ikeya et al. | 324/755 |
| 6,666,691 | B1 | | 12/2003 | Ikeya | 439/71 |
| 2003/0008544 | A1 | * | 1/2003 | Nakano | 439/331 |

* cited by examiner

*Primary Examiner*—Michael C. Zarroli
(74) *Attorney, Agent, or Firm*—TraskBritt, PC

(57) ABSTRACT

A socket for removably mounting an electronic device and which has utility for testing of the electronic device. The socket includes pinch-style support contacts which establish a reference seating plane for an IC package. The pinch-style support contacts each include a stationary contact arm, a movable contact arm, and a terminal portion. The stationary contact arm and the movable contact arm each include a contact surface configured to contact a terminal of the IC package. The stationary contact arm additionally includes an IC package support surface and extends beyond the height of the movable contact arm. A method of supporting and electrically connecting the socket and IC package is also disclosed.

44 Claims, 8 Drawing Sheets

PINCH-STYLE SUPPORT CONTACT, METHOD OF ENABLING ELECTRICAL COMMUNICATION WITH AND SUPPORTING AN IC PACKAGE, AND SOCKET INCLUDING SAME

BACKGROUND OF THE INVENTION

1. Field of the Invention

The present invention relates to a socket for removably mounting an electronic device. More specifically, the present invention relates to a pinch-style support contact configured to establish a reference seating plane for an integrated circuit (IC) package within the socket, as well as provide electrical communication for the IC package and the socket.

2. State of the Art

Testing a semiconductor die often involves establishing an electrical connection between testing equipment and the integrated circuitry of the die. Testing may be performed on an unpackaged semiconductor die that has been singulated from a semiconductor wafer, on a section of semiconductor dice that are still part of the wafer, or on all of the semiconductor dice on a wafer. Moreover, a bare semiconductor die that has undergone packaging may also be tested. One example of such a packaged semiconductor die is a so-called "flip-chip," wherein discrete conductive elements, such as solder balls, are attached directly to or formed on the bond pads or redistributed bond pads at the ends of electrical traces formed on the active surface of the semiconductor die. The die is then "flipped," or mounted face down, so that the solder balls may connect with contact members of another device, such as terminal pads of a carrier substrate. Another example is a "chip scale package," which includes a die along with one or more package elements, such as encapsulating material in the form of thin protective coatings formed of a dielectric material bonded to the active surface, sides and back side of the semiconductor die; in addition, solder balls may be attached to or formed on ends of electrical traces on the active surface of the semiconductor die or directly to the semiconductor die's bond pads through openings in the encapsulating material. A Ball Grid Array (BGA) serves as yet another example that involves even more packaging: the semiconductor die is wire bonded to terminal pads on the top side of an interposer substrate and encapsulated, and solder balls are bonded to electrical traces on the bottom side of the substrate that are electrically connected to the terminal pads.

An electronic device to be tested will hereinafter be referred to as an integrated circuit package, or IC package, regardless of the singulation or packaging state of the semiconductor die or dice that form all or part of the IC package. One method of testing the IC package involves placing the IC package into a socket, which comprises a body with apertures that span through the body. These apertures house contact members that are aligned with electrical terminals of the IC package. For purposes of explanation only, it will be assumed that the terminals of the IC package are solder balls or other discrete conductive elements that protrude from the IC package. Often, the socket includes cover that, when closed, adjusts a slider to actuate arms of the contact members and engage the solder balls of the IC package. Contact members comprising arms which may open and close about solder balls may be referred to as pinch-style contacts. Once the IC package has been inserted, the socket may then be plugged into a printed circuit board (PCB) or other carrier substrate.

One example of a conventional socket with pinch-style contacts used in burn-in tests for electronic packages having BGA terminals is described in U.S. Pat. No. 6,350,138 issued to Atobe et al. (hereinafter "the '138 patent"), on Feb. 26, 2002. The '138 patent discloses, as shown in FIG. 1A and FIG. 1B hereof, a conventional socket 1 including a seating part 5*a* supporting a BGA package 9 on the periphery of the BGA package body.

The depicted socket 1 comprises a base 2 as the main socket body, a cover 3, a slider 4 mounted on the base 2, which serves as a contact part switching member, and an adaptor 5 mounted on the slider 4. The base 2 may be attached to a PCB (not shown) for testing the BGA package 9. The cover 3 is formed in the shape of a square frame with an opening at the center for the purpose of inserting the BGA package 9. The base 2 and cover 3 are relatively movable toward and away from each other while maintaining a mutually parallel state. Contact members 6 are provided at positions which correspond to solder balls 11 provided on the lower side of the BGA package 9. Each contact member 6 includes a pair of arms 6*a*, 6*b* for engaging a solderball 11. The slider 4 includes a lattice-like partition wall capable of moving in a vertical direction, thus engaging the contact members 6, causing the pair of arms of each contact member to open or close. A slider 4 capable of moving in a horizontal direction to engage the contact members 6 is also known in the art. The terminal portions 6*c* of the contact members 6 provide attachment to the PCB (not shown).

The contact members 6 pass through the base 2 and apertures 4*b* of the slider 4. The contact arms 6*a*, 6*b* include tips 7, located within substantially the same plane. The seating part 5*a* supporting the BGA package 9 creates a seating plane, the plane of a bottom surface 8 of the IC package body, or substrate 10. One difficulty in the construction of the socket 1 is ensuring that the plane of the contact arm tips 7 is parallel to the seating plane. In addition, the spacing of the plane of the contact arm tips 7 must be a proper distance from the seating plane to ensure reliable electrical connection, as described further hereinbelow. The seating part 5*a* and the base 2 conventionally comprise plastic, and tolerances for forming plastic parts are typically high relative to the tolerances for the conventional stamping and stitching processes for forming contact members 6. Tolerance stacking, or accumulation, of tolerances of a plurality of components may add to the error introduced by the individual tolerances. Nonplanarities in the seating part 5*a*, as well as nonplanarities in the IC package substrate 10, for example, bowing, may further contribute to error in the seating plane, and therefore error in the spacing between the seating plane and the plane of the contact arm tips 7.

One example of a problem resulting from improper spacing between the plane of the contact arm tips 7 of a socket 1 and the seating plane of the BGA package 9 is that a trace (not shown) on a bottom surface 8 of the IC package substrate 10 may interfere with the movement of a contact arm 6*a*, 6*b* if the seating plane of the IC package is positioned too close to the plane of the contact arm tips 7. The trace may protrude from the bottom surface 8 of the IC package substrate 10. The contact arm tip 7 of a moving contact arm 6*a* or 6*b* may intersect the trace, preventing further movement, and therefore, contact with the solder ball 11. If the contact member touches or rubs against the BGA package substrate 10, especially while moving to make contact with the solder ball 11, the bottom surface 8 of the IC package substrate 10 may be scratched, which may result in unreliability of the BGA package 9 in later service due to entry of moisture or other contaminants or undetected damage to circuitry, since scratches may damage the passivation layer on the IC package substrate 10, or may expose the underlying traces and cause shorts.

Another problem with spacing error results from the contact arm tips 7 touching the BGA package 9. The IC package substrate 10 may expand, for example during an increase in temperature, such as burn-in testing. Contact arm tips 7 touching the IC package substrate 10 when the IC package substrate 10 expands may move with the expansion of the IC package substrate 10, causing the contact arms 6*a*, 6*b* to pull apart and lose reliable electrical communication with the solder ball 11.

A third concern in relation to BGA package test sockets is that the IC package may not be held in the socket securely enough to maintain a valid testing process through sufficient continuous electrical communication between the socket and the IC package, yet not so securely held that the IC package or its electrical connections are damaged, particularly during removal of the IC package from the test socket.

In view of the foregoing, it appears that a socket with an improved seating plane for an IC package and a method of forming electrical connection with improved accuracy between a socket and an IC package would be useful.

BRIEF SUMMARY OF THE INVENTION

The present invention, in a number of exemplary embodiments, includes a socket employing a contact member in the form of a pinch-style support contact configured to establish a reference seating plane for an IC package within the socket as well as provide electrical communication between terminals of the IC package and the socket. By using an array of the pinch-style support contacts, the IC package may be securely held within the socket with increased accuracy in comparison to conventional sockets. As used herein, the term "terminal" includes any discrete conductive element protruding from an IC package, such as, without limitation, a solder ball, a metal ball, bump, pin or post, a conductive or conductor-filled polymer bump, stud or pillar, or a conductive-coated dielectric structure.

In accordance with one aspect of the present invention, a socket includes a plurality of pinch-style support contacts. Each pinch-style support contact comprises a stationary contact arm and a movable contact arm extending from a terminal portion. The stationary contact arm and the movable contact arm each include a contact surface configured to contact a terminal of the IC package. The terminal portion of each pinch-style support contact may be in electrical communication with the stationary contact arm and the movable contact arm, and configured for attachment to a PCB or other carrier substrate. The stationary contact arm includes an IC package support surface and extends distally beyond the height of the movable contact arm.

The socket may also include a slider or other actuation structure positioned and configured to movably, selectively engage each movable contact arm of the plurality of pinch-style support contacts to effect lateral movement thereof with respect to its associated, stationary contact arm. The contact surface of the movable contact arm may include, for example, a beak-like protrusion. The contact surface of the stationary contact arm may, for example, be substantially planar. The stationary contact arm and the movable contact arm may be configured for symmetrical or, alternatively, asymmetrical engagement with a terminal of the IC package. The movable contact arm and the stationary contact arm are fixed to the terminal portion, and at least the movable contact arm may, in one exemplary embodiment, be formed of a material resilient or elastic in bending to cause it to return toward a neutral, or unbiased, position when out of engagement with the slider or other actuation structure.

A socket according to the present invention may employ a plurality of pinch-style support contacts arranged in a two-dimensional array in a pattern and spacing or pitch mirrored to that of an array of terminals of an IC package. Another embodiment of a socket of the present invention also comprises an array of contact members, selected contact members being pinch-style support contacts of the present invention and the balance of the contact members comprising conventionally configured contact members. In either embodiment, the stationary contact arms of each pinch-style support may be configured to support an IC package and establish a reference seating plane.

Yet another embodiment of a socket of the present invention may employ a plurality of pinch-style support contacts arranged in a two-dimensional array in a pattern and spacing or pitch mirrored to that of an array of terminals of an IC package in addition to a supplemental plurality of pinch-style support contacts. The plurality of pinch-style contacts and the supplemental plurality of pinch-style contacts together form a two-dimensional array having dimensions greater than those of the array of terminals of the IC package. Alternatively, the plurality of pinch-style contacts and the supplemental plurality of pinch-style support contacts may be arranged in a two-dimensional array in a pattern and spacing or pitch mirrored to that of a plurality of arrays of terminals of a like plurality of IC packages.

One embodiment of a method according to the present invention of enabling electrical communication between an IC package and a socket having a plurality of pinch-style support contacts includes moving movable contact arms of the plurality of pinch-style support contacts away from their associated stationary contact arms, supporting the IC package on stationary contact arms of the plurality of pinch-style support contacts, and causing the movable contact arms to move toward their associated stationary contact arms to engage terminals of the IC package. Movable contact arms of the plurality of pinch-style support contacts may be resiliently biased toward the stationary contact arms to contact terminals of the IC package or positively moved toward the stationary contact arms. Electrical communication with the terminals is established through the stationary contact arm and the movable contact arm of the pinch-style support contacts.

Other features and advantages of the present invention will become apparent to those of skill in the art through consideration of the ensuing description, the accompanying drawings, and the appended claims.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Generally, the present invention contemplates that a socket for removably mounting an IC package may include pinch-style support contacts which establish a reference seating plane for the IC package. A stationary arm of each pinch-style support contact may be used to support the IC package rather than the seating part of a conventional socket. Such a configuration may provide a socket with more consistent and reliable interconnect conditions. While the present invention is described herein in the context of a test socket, it is not so limited.

Figure 1A:
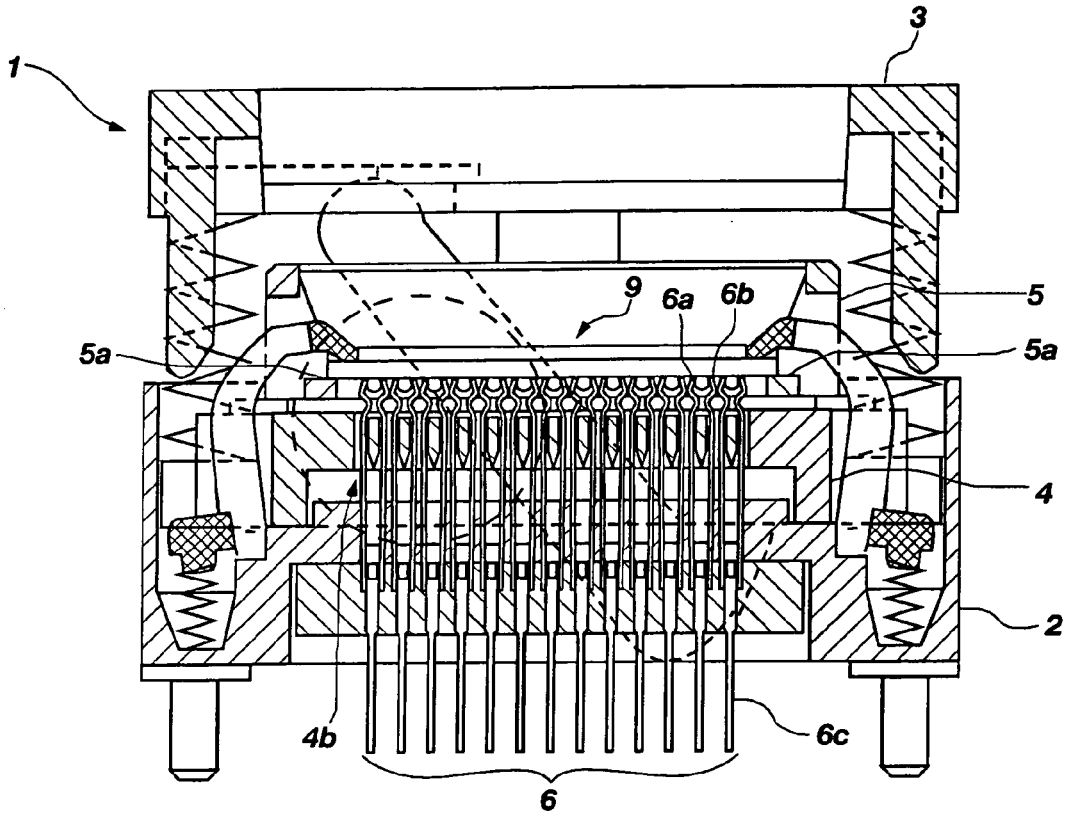
FIG. 1A (PRIOR ART)
FIG. 1A is a cross-sectional view of a conventional socket.
Figure 1B:
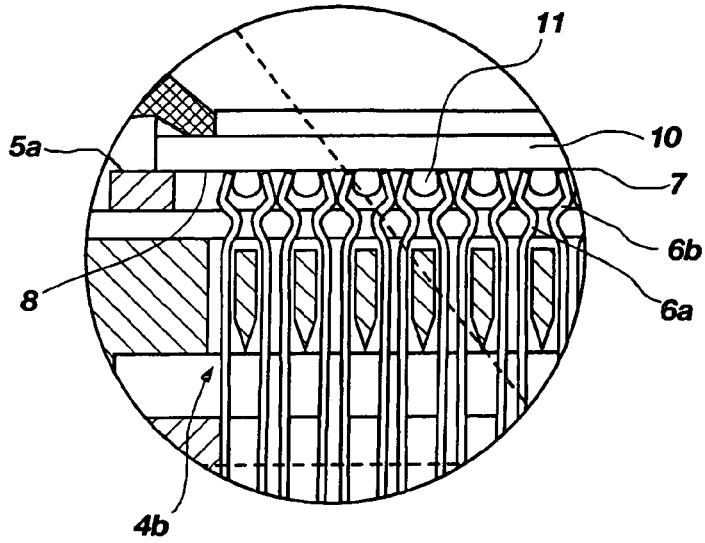
FIG. 1B (PRIOR ART)
FIG. 1B is an enlarged portion of FIG. 1A.
Figure 2:
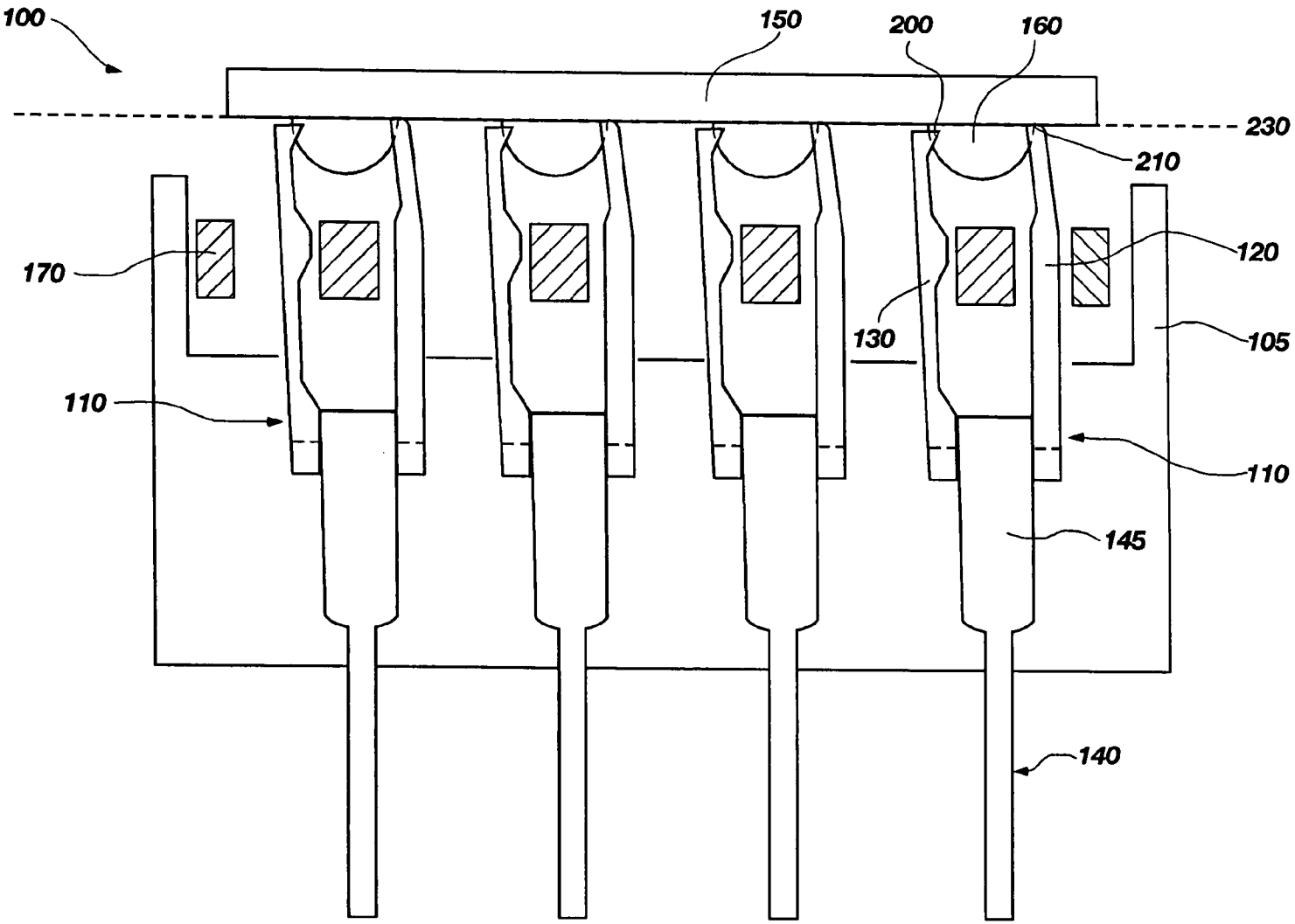
FIG. 2 is a cross-sectional view of a schematic representation of a socket of the present invention and an engaged IC package.

In accordance with one aspect of the present invention, as depicted in FIG. 2, a socket 100 is provided having pinch-style support contacts 110. The pinch-style support contacts 110 may be formed of any suitable material, such as beryllium copper, copper alloy, phosphor bronze or any other conductive material suitable for contact members as known in the art. Each pinch-style support contact 110 includes a stationary contact arm 120, a movable contact arm 130, and a terminal portion 140 from which the stationary contact arm 120 and the movable contact arm 130 extend distally. As depicted and not by way of limitation, at least the movable contact arm 130 is cantilevered from terminal portion 140 and is formed from a conductive material resilient or elastic in bending, at least through a contemplated range of motion for movable contact arm 130. The socket 100 is shown with a plurality of pinch-style support contacts 110 engaging an IC package 150 including terminals 160. The terminals 160 are depicted as solder balls; however, the pinch-style support contacts of the present invention may be useful for engaging the terminals of any IC package wherein the terminals comprise discrete conductive elements, such as are employed in a flip-chip assembly, a pin grid array, or a ball grid array.

The stationary contact arm 120 and the movable contact arm 130 of socket 100 extend upwardly from a dielectric base member 105 thereof. The terminal portion 140 of each pinch-style support contact 110 may extend downwardly from the base member 105 to provide attachment for socket 100 to a PCB (not shown) or other carrier substrate. A slider 170 carried by the socket 100 may be used to initiate lateral movement of each movable contact arm 130 with respect to each stationary contact arm 120 to open and close each pinch-style support contact 110. This enables an IC package to be removably mounted, that is, inserted, secured to and then removed from the socket 100. The slider 170 may comprise a lattice-like partition wall mounted for movement in base member 105 in a horizontal or vertical direction. The movement of the slider 170 is conventionally actuated by an external force, for example, if a cover (not shown) of the socket 100 is pressed down.

Figure 3B:
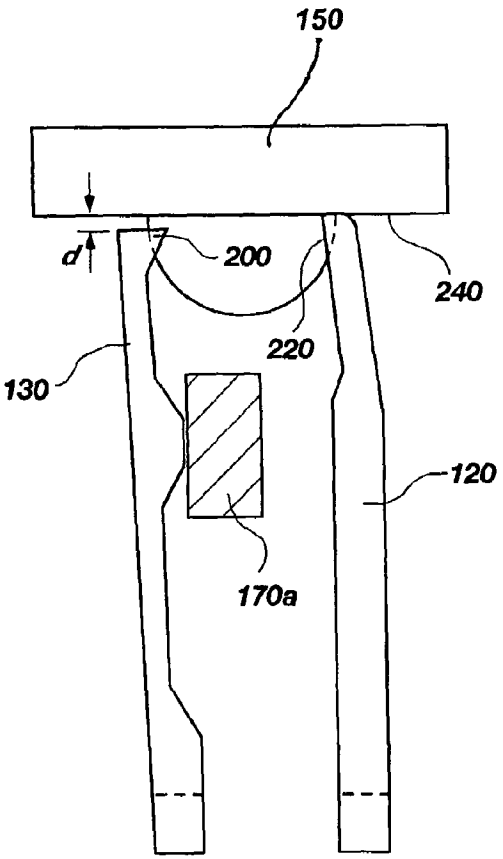
FIG. 3B is a front view of a schematic representation of a pair of contact arms of the present invention in a closed position and a terminal of an IC package.
Figure 3A:
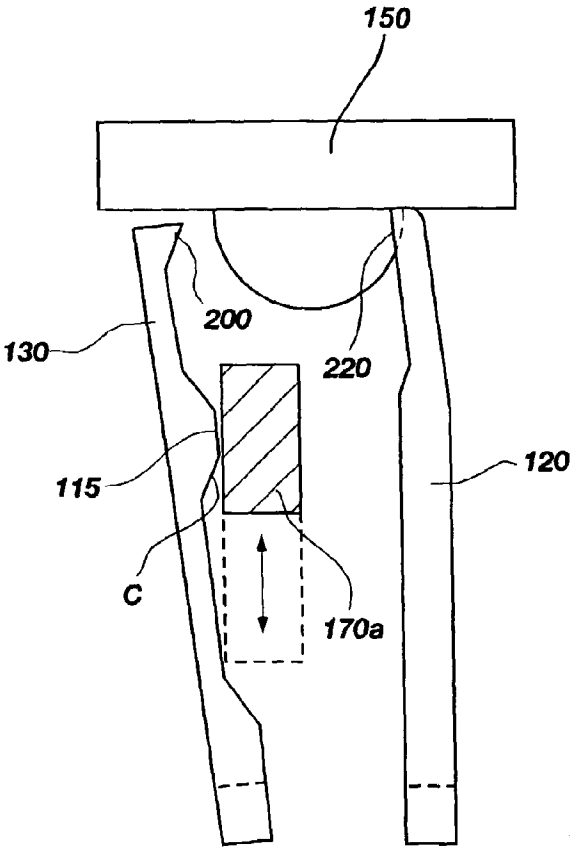
FIG. 3A is a front view of a schematic representation of a pair of contact arms of the present invention in an open position and a terminal of an IC package.

FIG. 3A depicts a movable contact arm 130 in an open position with respect to its associated stationary contact arm 120 for receiving a terminal 160 of the IC package 150. A partition wall 170*a* (not shown) of the slider 170 may be moved in a first horizontal (with respect to socket 100) direction to engage with the movable contact arm 130 to actuate lateral movement thereof away from stationary contact arm 120, resiliently biasing the movable contact arm 130 into the open position. The slider 170, as shown, is movable in the horizontal direction to actuate this lateral movement. However, it is contemplated within the scope of the invention that a slider that is movable, for example upwardly, against a cam surface C of movable contact arm 130 in a vertical direction as shown in broken lines in FIG. 3A may be used to initiate the lateral movement. An engagement protrusion 115 which is to be selectively engaged with the slider 170 and which may include cam surface C may be provided on the movable contact arm 130.

The movable contact arm 130 may be actuated to a closed position as depicted in FIG. 3B with respect to the stationary contact arm 120 by a horizontal movement of the slider 170 in the opposite horizontal direction, which as shown, permits resiliently biased movable contact arm 130 to move toward stationary contact arm 120. Electrical communication is thus provided between the movable contact arm 130, the stationary contact arm 120, and terminal 160 of IC package 150. This provides electrical communication between the socket 100 and the IC package 150 for testing. The IC package 150 may be removed by actuating the slider 170 once again to place the movable contact arm 130 in an open position.

The present invention may be implemented using a slider 170 and movable contact arm 130 cooperatively configured to open and close each pinch-style support contact 110 in a variety of ways. For example, as described above, the movable contact arm 130 may be elastically deformed to the open position and returned by its elastic property to the closed position. Conversely, the movable contact arm 130 may be elastically deformed by slider contact and movement to the closed position and returned by its elastic property to the open position. Alternatively, the movable contact arm 130 may be positively biased by contact with slider 170 to both the open and the closed position. In such an instance, the movable contact arm 130 need not be of a resilient or elastic material and may be hinged or otherwise configured to be pivotable at its proximal end with respect to terminal portion 140. It is further understood that structure for effectuating lateral movement of the movable contact arm 130 need not be restricted to a horizontally or vertically movable slider. It is contemplated that any device configured for biasing the movable contact arm 130 may be employed in a socket of the present invention. For example, an eccentric cam placed proximate to movable contact arm 130 proximate a protrusion 115 and rotatable about a horizontal axis may be used to initiate movement of movable contact arm 130 toward and away from its associated stationary contact arm 120.

Figure 4B:
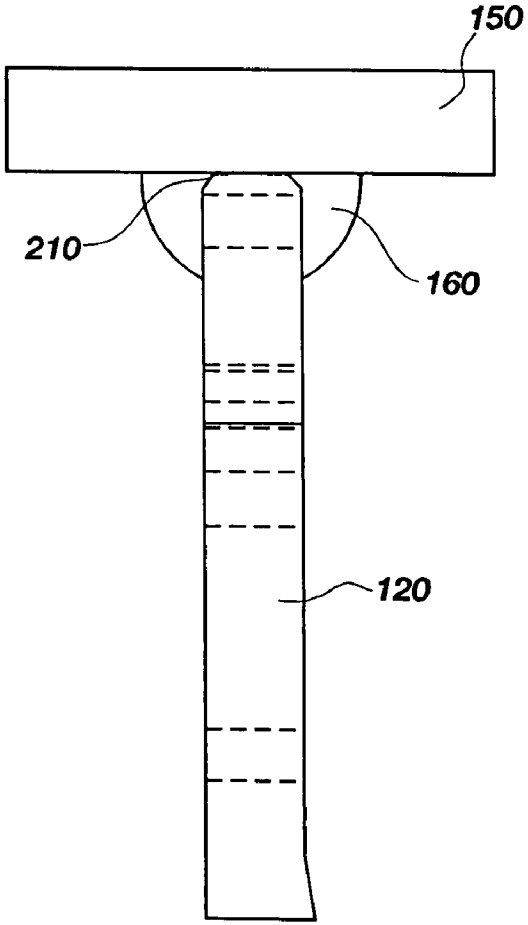
FIG. 4B is a right-side view of the contact arms and terminal of FIG. 3B.
Figure 4A:
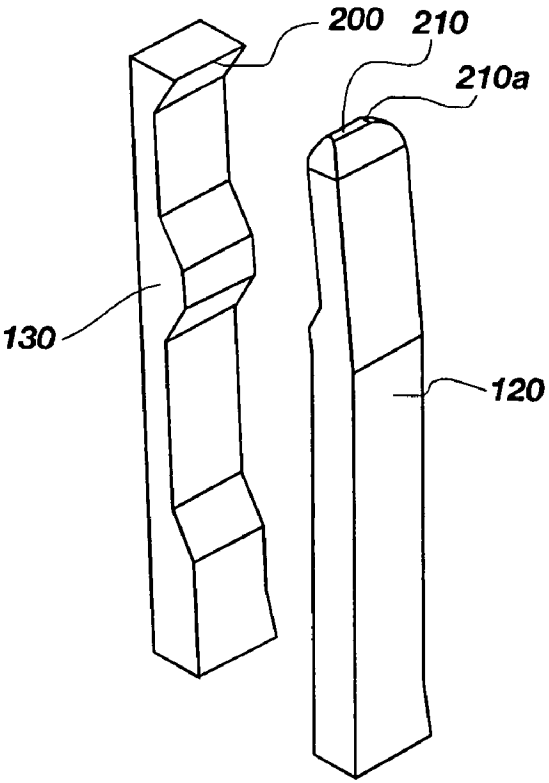
FIG. 4A is a perspective view of a pair of contact arms of the present invention.

Returning to FIG. 2, the stationary contact arm 120 may be configured to support the IC package 150 on a support surface 210*a* of a distal tip 210 thereof The distal tip 210 of the stationary contact arm 120 may protrude vertically a distance d above the movable contact arm 130 (see FIG. 3B). The distance dmay vary in different sockets 100 depending on the size of the terminals 160 to be engaged and, ideally, is the smallest distance possible which does not permit a distal tip of a movable contact arm 130 to drag on a surface of an IC package supported on stationary contact arm 120, but still effectively clamp the smallest potential terminal 160. Terminals 160, which comprise solder balls having a 0.1 mm height, are preferably engaged by a movable contact arm 130 and a stationary contact arm 120 having a distal tip 210 protruding vertically a distance d of between about 30 and 50 microns above the distal end of movable contact arm 130. The distance d may be greater in a socket 100 configured for engagement with an IC package having, for example, solder balls of an increased diameter. The socket 100 may include an array of the pinch-style support contacts 110, and the distal tip 210 of each stationary contact arm 120 may support the IC package 150, establishing a reference seating plane 230 for the IC package 150. The geometry of the distal tip 210 of the stationary contact arm 120 may be configured to be non-intrusive to minimize the damage and/or inhibition of the performance of the IC package 150 from, for example, scratching of the surface. The distal tip 210 of the stationary contact arm 120 may be radiused, coined or chamfered at its edges or periphery to provide such a smooth, non-intrusive tip geometry, as shown in FIG. 4A. FIG. 4B depicts the distal tip 210 in a right-side view of the stationary contact arm 120 of FIG. 4A and an engaged terminal 160 of an IC package 150.

Returning again to FIG. 3B, the stationary contact arm 120 includes a contact surface 220 configured to contact the terminal 160. The contact surface 220 may be configured to provide sufficiently low Hertzian stress to minimize penetration into the terminal 160, particularly during exposure to elevated temperatures, for example, during burn-in testing. "Burn-in" refers to the process of accelerating early-life failures. This is done by cycling a semiconductor die through a series of stresses at elevated temperature designed to simulate extreme field conditions in an attempt to cause failure of the die and provide a way to identify and remove from production those semiconductor dice which would have otherwise failed during early field use. A solder ball, particularly, may be softened at elevated temperatures, and the arms of a contact member may stick to the softened solder ball after the completion of the burn-in test, making it difficult to remove the IC package from the socket. The Hertzian stress formula may be useful for predicting local stresses and deformations at the point of contact depending on elastic properties, the size and shape of the contact zone, and relative position of the two bodies at the point of contact and the force pushing them together. The contact surface 220 depicted in FIG. 3B is a substantially planar surface, which is one example of a surface configured to provide sufficiently low Hertzian stress.

The movable contact arm 130 may have a beak-like protrusion 200 to concentrate stress against, and provide good contact with, the terminal 160. The beak-like protrusion 200 may provide better contact by piercing any oxidation which may have formed on the surface of terminal 160. Any bond with terminal 160 which may cause the beak-like protrusion 200 thereto will likely be broken when the movable contact arm 130 is pulled away from the terminal 160. The slider 170 may be moved to engage the movable contact arm 130 to compel lateral movement thereof with respect to the stationary contact arm 130, and the beak-like protrusion 200 located at the distal tip of the movable contact arm 130 may be pulled away in an arc. The resulting twisting motion may help break the bond between a beak-like protrusion 200 and a terminal 160. The beak-like protrusion 200 may be located and oriented on movable contact arm 130 to contact the terminal 160 at the widest part of the terminal 160, that is, the portion of the terminal 160 where the diameter becomes the largest relative to planes parallel to the bottom surface 240 of the IC package 150. The beak-like protrusion 200 of the movable contact arm 130 is preferably positioned to contact the widest portion of a terminal 160 comprising a solder ball to avoid slippage of the movable contact arm 130 against the surface of terminal 160 or an unreliable contact therewith.

The nominal diameter or a range of diameters of the solder balls may be used to determine an optimum distance d, the difference in vertical protrusion of the stationary contact arm 120, and therefore the reference seating plane, over the movable contact arm 130 in a socket 100. An accurate reference seating plane may thus be useful to ensure that the solder balls are clamped at a desired location, for example, at the widest portion of each solder ball.

Figure 4C:
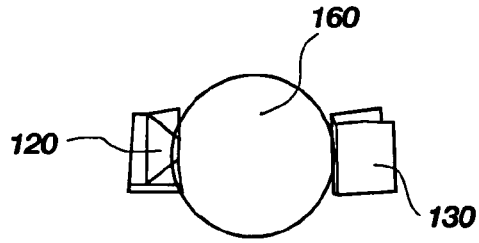
FIG. 4C is a plan view of the contact arms and terminal of FIG. 4B.
Figure 6A:
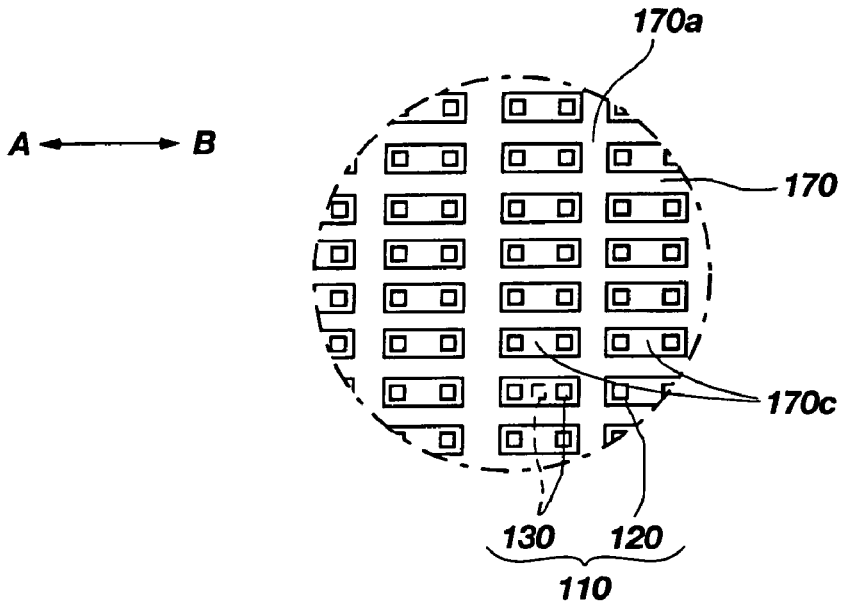
FIG. 6A is a top plan view of the contact arms of FIG. 4C arranged within a slider.

The stationary contact arm 120 and the movable contact arm 130 may be configured to symmetrically engage each terminal 160 of the IC package 150, as depicted in the right side view of FIG. 4B and overhead view of FIG. 4C. As shown, the symmetrical engagement may be effected diametrically across a terminal 160. The stationary contact arm 120 and the movable contact arm 130 may be arranged on opposite sides of a partition wall 170*a* of the slider 170 as seen in FIG. 6A. Each stationary contact arm 120 and its associated movable contact arm 130 of each pinch-style contact 110 are therefore arranged within separate but adjacent contact receiving apertures 170*c*. Upon movement of the slider 170 in the direction indicated by arrowhead A, a movable contact arm 130 may be moved to the open position as shown in broken lines in FIG. 6A relative to the stationary contact arm 120.

Figure 5A:
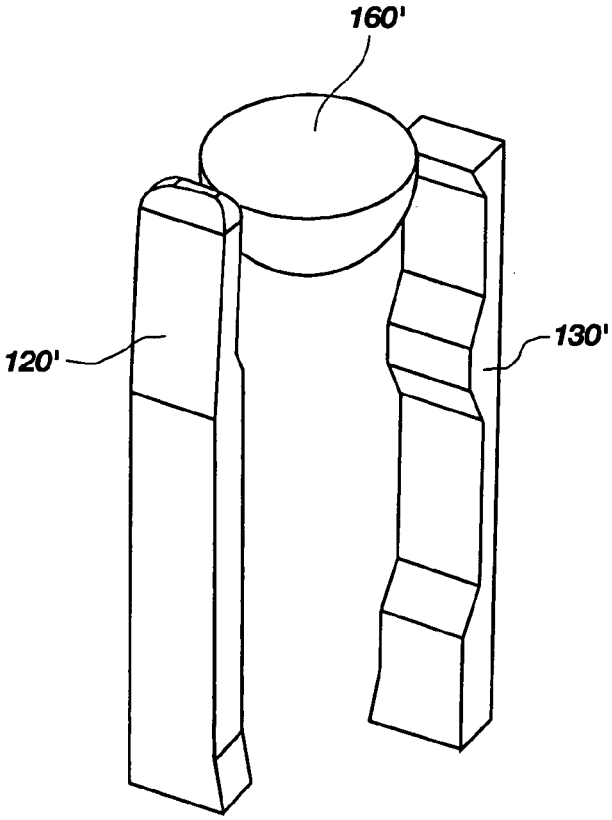
FIG. 5A is a perspective view of another embodiment of a pair of contact arms of the present invention and an engaged terminal of an IC package.
Figure 5B:
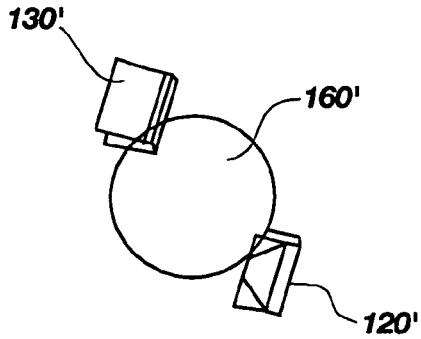
FIG. 5B is a plan view of the contact arms and terminal of FIG. 5A.
Figure 6B:
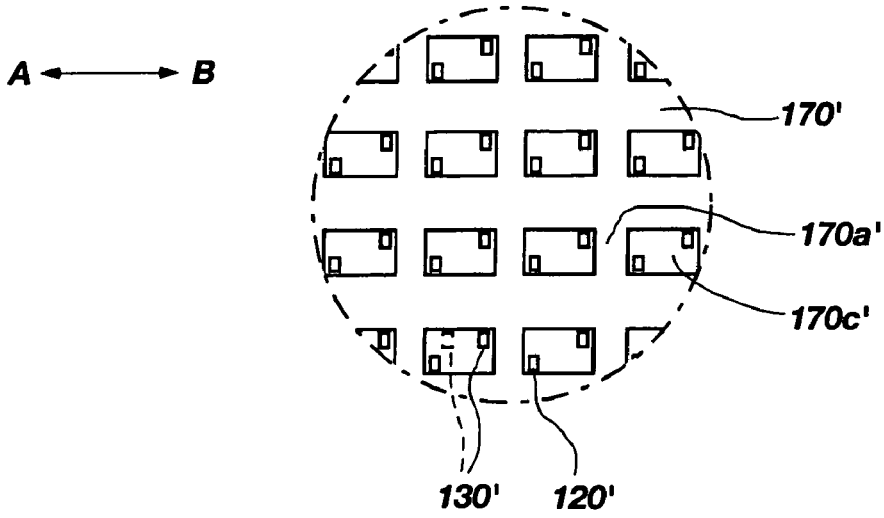
FIG. 6B is a top plan view of the contact arms of FIG. 5B arranged within another slider.

Alternatively, a stationary contact arm 120' and its associated movable contact arm 130' may be configured to asymmetrically engage a terminal 160', as depicted in the plan side view FIG. 5A and overhead view FIG. 5B. As illustrated, the asymmetric contact is effected by stationary contact arm 120' and its associated movable contact arm 130' at positions offset from a diameter of terminal 160'. The stationary contact arm 120' and its associated movable contact arm 130' may be arranged on opposite sides of the partition wall 170*a'* of the slider 170' as seen in FIG. 6B. Upon movement of the slider 170' in the direction indicated by arrowhead A, the movable contact arm 130' is moved to the open position as shown in broken lines relative to the stationary contact arm 120'. The stationary contact arm 120' and the movable contact arm 130' may be positioned within diagonally opposing corners of the contact receiving aperture 170*c'*, resulting in the asymmetric engagement with the terminals 160'.

Figures 7A, 7B, 7C, 7D:
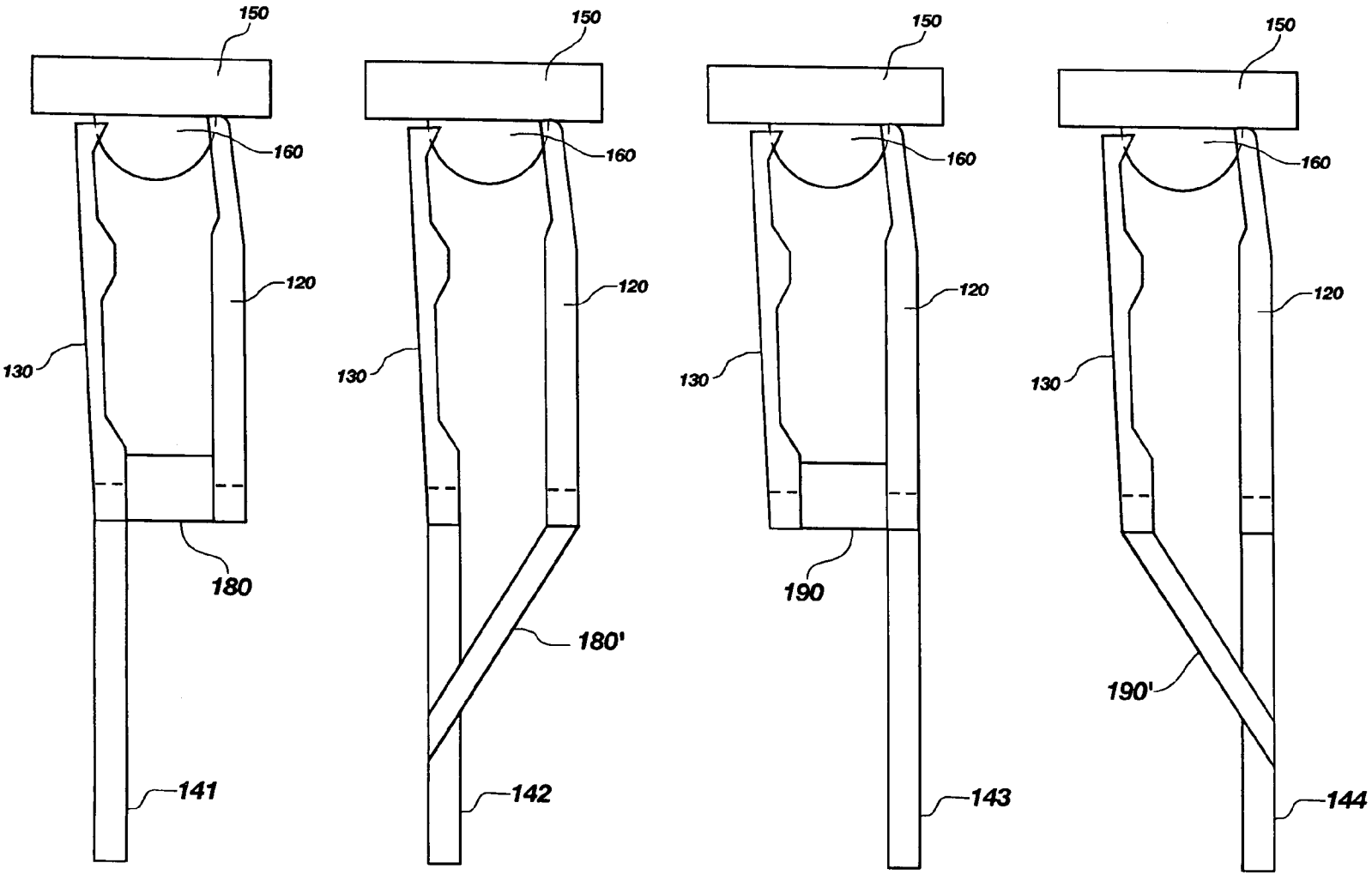
FIGS. 7A–7D are schematic representations of embodiments of pinch-style contacts of the present invention and a partial view of an IC package.

The present invention contemplates that there are many geometric configurations for the terminal portion 140 of the pinch-style support contact 110, which may provide a point of attachment for the socket to a PCB or other carrier substrate (not shown). By way of example, and not to limit the scope of the present invention, as pictured in FIG. 2, a proximal segment 145 of the terminal portion 140 of the pinch-style support contact 110 may be positioned between the movable contact arm 130 and the stationary contact arm 120. Alternatively, illustrated in FIG. 7A, a terminal portion 141 of the pinch-style support contact 110 may comprise an extension of the movable contact arm 130 and a linking element 180 disposed between cantilevered stationary contact arm 120 and a medial portion of movable contact arm 130. The linking element 180 may provide both electrical communication and mechanical connection between the stationary contact arm 120 and movable contact arm 130. FIG. 7B illustrates another configuration for a linking element 180' of a terminal portion 142. As shown in FIG. 7C, the terminal portion 143 of the pinch-style contact 110 may comprise an extension of the stationary contact arm 120 and a linking element 190 from which movable contact arm 130 is cantilevered. The linking element 190 may provide both electrical communication and mechanical connection between the stationary contact arm 120 and movable contact arm 130. FIG. 7D illustrates another configuration for the linking element 190' of the terminal portion 144 wherein terminal portion 144 may comprise an extension of stationary contact arm 120.

Figure 8:
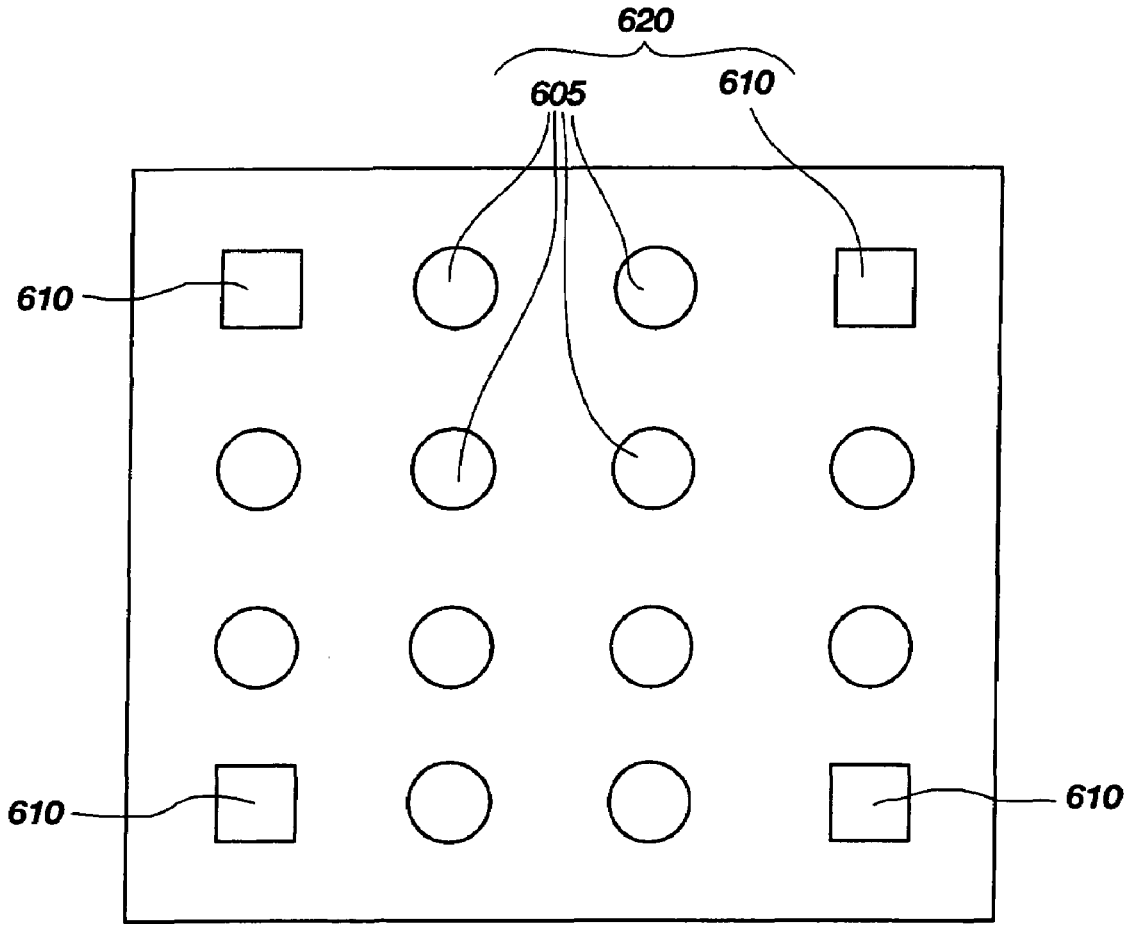
FIG. 8 is a schematic representation of an array of contact members in a socket.

A socket may comprise a plurality of contact members in an array in mirrored pattern and pitch to an array of terminals of an IC package and may be dimensioned such that each terminal thereof is discretely connected to the socket in electrical communication sufficient to test the IC package. Each of the contact members of a socket may comprise pinch-style support contacts 110 of the present invention, as shown in FIG. 2. The present invention also contemplates that a conventional socket may be refurbished, replacing a number of the conventional contact members comprising a pair of contact arms with pinch-style support contacts sufficient in a given arrangement to provide support for an IC package. Alternatively, a socket may be configured according to the present invention to employ both conventional contact members and support contacts of the present invention. In either instance, the stationary contact arms of the pinch-style support contacts of the present invention will extend above the upper ends of the conventional contact members to provide a reference plane for support of the IC package. As depicted in FIG. 8, a socket having an array 620 of contact members may have pinch-style support contacts 610 of the present invention positioned at the corners of the array 620. The pinch-style support contacts 610 may thus be used to provide a reference seating plane for an IC package. Conventional contact members 605 may be used to complete the array of contact members.

In addition, it will be understood that while an array of 16 contact members, including four pinch-style support contacts 610 is shown in FIG. 8, the present invention includes within its scope sockets carrying any number of contact members, and any number of pinch-style support contacts according to the present invention employed therein in any suitable arrangement or pattern. For example, a socket of the present invention may include a plurality of pinch-style support contacts arranged in a two-dimensional array. A portion of the plurality of pinch-style support contacts may be arranged in a pattern and spacing or pitch mirrored to that of an array of terminals of a first IC package. The balance of the plurality of pinch-style support contacts comprise a supplemental plurality of pinch-style support contacts. The socket may therefore be used for testing a second IC package having an array of a greater number of terminals, without changes to the socket. Yet another embodiment of the socket of the present invention includes a plurality of pinch-style contacts arranged in a two-dimensional array in a pattern and spacing or pitch mirrored to that of a plurality of arrays of terminals of a like plurality of IC packages. The socket may therefore be used for simultaneously supporting a plurality of IC packages.

As will be appreciated by those of ordinary skill in the art, the present invention enables improved accuracy for forming electrical connection between a socket and an IC package. The features of the socket which are the most tightly controlled during socket manufacture, the contact arms, are used to establish a reference seating plane on which an IC package may be supported. The establishment of a reference seating plane provides accurate and sufficient vertical spacing or standoff between movable contact arms of the socket and the plane of the IC package. Accurate and sufficient vertical spacing or standoff removes the IC package from the potential for damaging shear contact with a movable contact arm which may compromise package integrity or electrical function, prevent damage to the IC package substrate and terminals, and provide more reliable electrical connection, thus overcoming previously experienced testing problems.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. Moreover, the methods and devices described above are not limited to testing circumstances; rather, they could also be used for interconnect devices in permanent or semipermanent packaging. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

The invention claimed is:

1. A socket for electrically communicating with an IC package, the socket comprising:
- a base member;
- a plurality of contact members carried by the base member, at least some of the contact members of the plurality comprising pinch-style support contacts, each comprising:
  - a stationary contact arm extending upwardly from the base member and including a distal tip comprising an IC package support surface; and
  - a movable contact arm extending upwardly from the base member a lesser distance than the stationary contact arm to a distal tip, the movable contact arm adapted for lateral movement of at least the distal tip thereof with respect to the stationary contact arm and in electrical communication with the stationary contact arm; and
  - a terminal portion in electrical communication with the stationary contact arm and the movable contact arm.

2. The socket of claim 1, further comprising a slider having a plurality of contact receiving apertures therethrough, each movable contact arm of the pinch-style support contacts received through a contact receiving aperture of the plurality of contact receiving apertures.

3. The socket of claim 2, wherein the slider is configured to engage each movable contact arm of pinch-style support contacts to effect lateral movement thereof with respect to an associated stationary contact arm.

4. The socket of claim 1, wherein each movable contact arm distal tip comprises a beak oriented at least generally toward an associated stationary contact arm.

5. The socket of claim 1, wherein each stationary contact arm further comprises a substantially planar contact surface oriented at least generally toward an associated movable contact arm.

6. The socket of claim 5, wherein the substantially planar contact surface is substantially perpendicular to the IC package support surface.

7. The socket of claim 1, wherein the lesser distance comprises about 30 to about 50 microns.

8. The socket of claim 1, wherein the IC package support surface comprises a substantially planar surface having radiused, coined or chamfered edges.

9. The socket of claim 1, wherein the plurality of contact members comprises at least one of beryllium copper, copper alloy, and phosphor bronze.

10. The socket of claim 1, wherein the plurality of contact members is arranged in a two-dimensional array.

11. The socket of claim 10, wherein the two-dimensional array is of a pattern and pitch corresponding to a pattern and pitch of terminals protruding from the IC package.

12. The socket of claim 1, wherein others of the plurality of contact members comprise a pair of contact arms extending upwardly from the base member a lesser distance than the stationary contact arms of the at least some contact members comprising the pinch-style support contacts.

13. The socket of claim 12, wherein the plurality of contact members is arranged in a two-dimensional array.

14. The socket of claim 13, wherein each pinch-style support contact is positioned proximate a corner of the two-dimensional array.

15. The socket of claim 13, wherein the two-dimensional array comprises a pattern having greater dimensions than a pattern of an array of terminals of an IC package.

16. The socket of claim 13, wherein the two-dimensional array comprises a pattern and spacing or pitch mirrored to that of a plurality of arrays of terminals of a like plurality of IC packages.

17. The socket of claim 1, wherein a proximal segment of the terminal portion is positioned between the stationary contact arm and the movable contact arm.

18. The socket of claim 1, wherein the terminal portion comprises an extension of the movable contact arm and a linking element from which the stationary contact arm is cantilevered.

19. The socket of claim 1, wherein the terminal portion comprises an extension of the stationary contact arm and a linking element from which the movable contact arm is cantilevered.

20. The socket of claim 1, wherein the stationary contact arm and the movable contact arm are configured and oriented to asymmetrically contact a terminal of an IC package.

21. The socket of claim 1, wherein the stationary contact arm and the movable contact arm are configured and oriented to symmetrically contact a terminal of an IC package.

22. A pinch-style contact comprising a pair of contact arms for contacting a terminal of an IC package, the pair of contact arms comprising:

a support contact arm configured for supporting the IC package and having a distal tip comprising an IC package support surface lying in a first plane, wherein the support contact arm further comprises a contact surface, the contact surface being substantially planar; and a movable contact arm in electrical communication with the support contact arm and having a distal tip terminating in a second, different plane with respect to the IC package supporting surface.

23. The pinch-style contact of claim 22, wherein the movable contact arm includes a distal tip comprising a beak.

24. The pinch-style contact of claim 22, wherein the contact surface is substantially perpendicular to the IC package support surface.

25. The pinch-style contact of claim 22, wherein the first plane is located a distance of about 30 to about 50 microns from the second, different plane.

26. The pinch-style contact of claim 22, wherein the IC package support surface comprises a substantially planar surface having radiused, coined or chamfered edges.

27. The pinch-style contact of claim 22, wherein the support contact arm comprises at least one of beryllium copper, copper alloy, and phosphor bronze.

28. A method of enabling electrical communication between an IC package and at least a socket, comprising:

providing a socket having a plurality of contact members, each contact member of the plurality of contact members comprising a movable contact arm and an associated stationary contact arm;

supporting a lower surface of the IC package on the stationary contact arms of the plurality of contact members while maintaining the associated movable contact arms free of contact with the lower surface of the IC package; and contacting a terminal protruding from the lower surface of the IC package with each stationary contact arm and an associated movable contact arm for electrical communication therewith by causing each movable contact arm to move toward its associated stationary contact arm.

29. The method of claim 28, wherein causing each movable contact arm to move toward the associated stationary contact arm comprises permitting a resilient bias in each movable contact arm, to move that movable contact arm toward the associated contact arm.

30. The method of claim 28, wherein supporting the IC package comprises positioning the lower surface of the IC package in a reference seating plane defined by distal tips of the stationary contact arms a vertical distance above distal tips of the movable contact arms.

31. The method of claim 28, wherein contacting the terminal protruding from the lower surface of the IC package includes piercing oxidation on the terminal of the IC package with at least one movable contact arm and the associated contact arm.

32. The method of claim 28, wherein causing each associated movable contact arm to move toward the stationary contact arm comprises releasing engagement of each associated movable contact arm with an actuation structure.

33. The method of claim 28, wherein causing each associated movable contact arm to move toward the stationary contact arm comprises asymmetrically contacting each terminal of the IC package with each movable contact arm and its associated stationary contact arm.

34. The method of claim 28, wherein causing each associated movable contact arm to move toward the stationary contact arm comprises symmetrically contacting each terminal of the IC package with each movable contact arm and its associated stationary contact arm.

35. The method of claim 28, wherein contacting the terminal of the IC package with the stationary contact arm comprises contacting the terminal of the IC package with a substantially planar surface.

36. The method of claim 28, wherein causing each associated movable contact arm to move toward the stationary contact arm comprises contacting each terminal at substantially a widest portion thereof.

37. The method of claim 28, wherein causing each associated movable contact arm to move toward the stationary contact arm comprises positively displacing the movable contact arms toward their stationary contact arms.

38. The method of claim 37, wherein positively displacing the associated movable contact arms toward the stationary contact arms comprises positive displacing the movable contact arms against a resilient bias.

39. The method of claim 28, further comprising causing the associated movable contact arms to move away from the stationary contact arms prior to supporting the lower surface of the IC package on the stationary contact arms.

40. The method of claim 28, further comprising electrically connecting the plurality of contact members of the socket to a carrier substrate.

41. A method of securing an IC package including a plurality of terminals to a socket, comprising:

orienting an IC package over a socket such that the plurality of terminals are positioned over a like plurality of contact members of the socket;

supporting the IC package with support contact arms of the plurality of contact members while maintaining movable contact arms of the plurality of contact members out of contact with the IC package; and securing the plurality of terminals protruding from the IC package to the socket by causing the movable contact arms to move toward associated support contact arms to establish electrical communication between the plurality of contact members and the plurality of terminals.

42. The method of claim 41, wherein securing the plurality of terminals comprises asymmetrically contacting each terminal of the plurality of terminals between a movable contact arm and an associated support contact arm.

43. The method of claim 42, wherein securing the plurality of terminals comprises symmetrically contacting each terminal of the plurality of terminals between a movable contact arm and an associated support contact arm.

44. A method of retrofitting a socket, comprising:

providing a socket having a plurality of contact members for electrical communication with an IC package; and replacing at least some of the plurality of contact members with at least some pinch-style support contacts, each pinch-style support contact comprising:

a stationary contact arm for supporting the IC package and contacting a terminal of the IC package; and a movable contact arm for contacting a terminal of the IC package without touching a remainder of the IC package.

* * * * *